US007237289B2

(12) United States Patent
Loewenthal

(10) Patent No.: US 7,237,289 B2
(45) Date of Patent: Jul. 3, 2007

(54) PLATFORM FOR ADJUSTABLE HEIGHT BED

(75) Inventor: Howard Loewenthal, Hinckley, OH (US)

(73) Assignee: Invacare Corporation, Elyria, OH (US)

( * ) Notice: Subject to any disclaimer, the term of this patent is extended or adjusted under 35 U.S.C. 154(b) by 9 days.

(21) Appl. No.: 10/807,492

(22) Filed: Mar. 23, 2004

(65) Prior Publication Data

US 2005/0210588 A1 Sep. 29, 2005

(51) Int. Cl.
*A61G 7/00* (2006.01)
*A61G 7/05* (2006.01)

(52) U.S. Cl. ..... 5/620; 108/185; 108/158.12

(58) Field of Classification Search ..... 5/620, 5/618, 600, 613, 201, 202; 108/185, 158.12
See application file for complete search history.

(56) References Cited

U.S. PATENT DOCUMENTS 1,075,291 A * 10/1913 Kertesz ..... 5/285
4,202,062 A * 5/1980 Marcyan ..... 5/620
4,970,737 A * 11/1990 Sagel ..... 5/620
5,257,428 A * 11/1993 Carroll et al. ..... 5/620
5,283,919 A * 2/1994 Grant ..... 5/620
5,319,817 A * 6/1994 Hay et al. ..... 5/611
6,748,614 B1 * 6/2004 Hu ..... 5/620

OTHER PUBLICATIONS

"Invacare Corporation—Product Catalog Printable Detail Page—Bariatric Bed—600lb."; http://www.invacare.com/cgi-bin/imhqprd/inv_catalog/prod_cat_print_detail.jsp?s=0&oid . . . ; Downlaoded from the World Wide Web on Mar. 18, 2004, p. 1.
"Invacare BAR600 Bariatric Bed Manual"; www.invacare.com; 2000; p. 1-2.
"Assembly: Procedure 1—Bariatric Bed ONLY (Figure 2)"; p. 13.

* cited by examiner

*Primary Examiner*—Alexander Grosz
(74) *Attorney, Agent, or Firm*—Calfee, Halter & Griswold

(57) ABSTRACT

A bed frame for supporting a mattress includes at least first and second sections connectable to form a mattress supporting platform. The platform includes a latch to hold the first and second sections together. The latch includes engageable parts on the first and second sections that are engageable in response to relative sliding movement between the first and second sections toward each other when oriented horizontally.

6 Claims, 10 Drawing Sheets

20
40
44
42
80
78
83
76
85
74
83
82
70
72
54
50
22
90

20
40
44
42
78
83
83
82
70
54
50
22
90

20
40
42
78
83
44
83
82
70
54
50
22
90

PLATFORM FOR ADJUSTABLE HEIGHT BED

TECHNICAL FIELD

The present invention relates to a bed, for example, for use in home health care.

BACKGROUND OF THE INVENTION

Adjustable beds are often used in home health care. A bariatric bed is one capable of supporting the weight of a larger patient, and thus is typically larger and heavier than a standard home health care bed.

Home health care beds typically include two vertically adjustable bed ends that support a mattress platform extending between them. The mattress platform is made in two pieces, i.e., a head end section and a foot end section. The head end section has an adjustable portion that can be raised up when the bed is assembled, to raise the patient's head. The foot end section has an adjustable portion that can be raised up when the bed is assembled, to raise the patient's knees. The adjustable portions are operated by one or more electric motors located underneath the platform.

The head end section and the foot end section of the platform are assembled by standing them on edge, at an angle to each other. They are then moved into engagement with each other and joined, still at an angle, with a pin and slot arrangement. The two sections are pivoted relative to each other, while still on edge, into an orientation aligned with each other, to form the platform. The assembled platform may then be laid flat on the floor and the bed ends connected with it.

This assembly process takes up a significant amount of space in the room in which the bed is to be used—specifically, significantly more room than the finished size of the bed. In addition, the two sections are quite heavy—in the range of from 75 pounds to over 100 pounds each—and as a result, the on-edge assembly process requires two persons.

SUMMARY OF THE INVENTION

The present invention relates to a bed frame for supporting a mattress that includes at least first and second sections connectable to form a mattress supporting platform. The platform includes a latch to hold the first and second sections together. The latch includes engageable parts on the first and second sections that are engageable in response to relative sliding movement between the first and second sections toward each other when oriented horizontally.

DETAILED DESCRIPTION OF THE INVENTION

Figure 1:
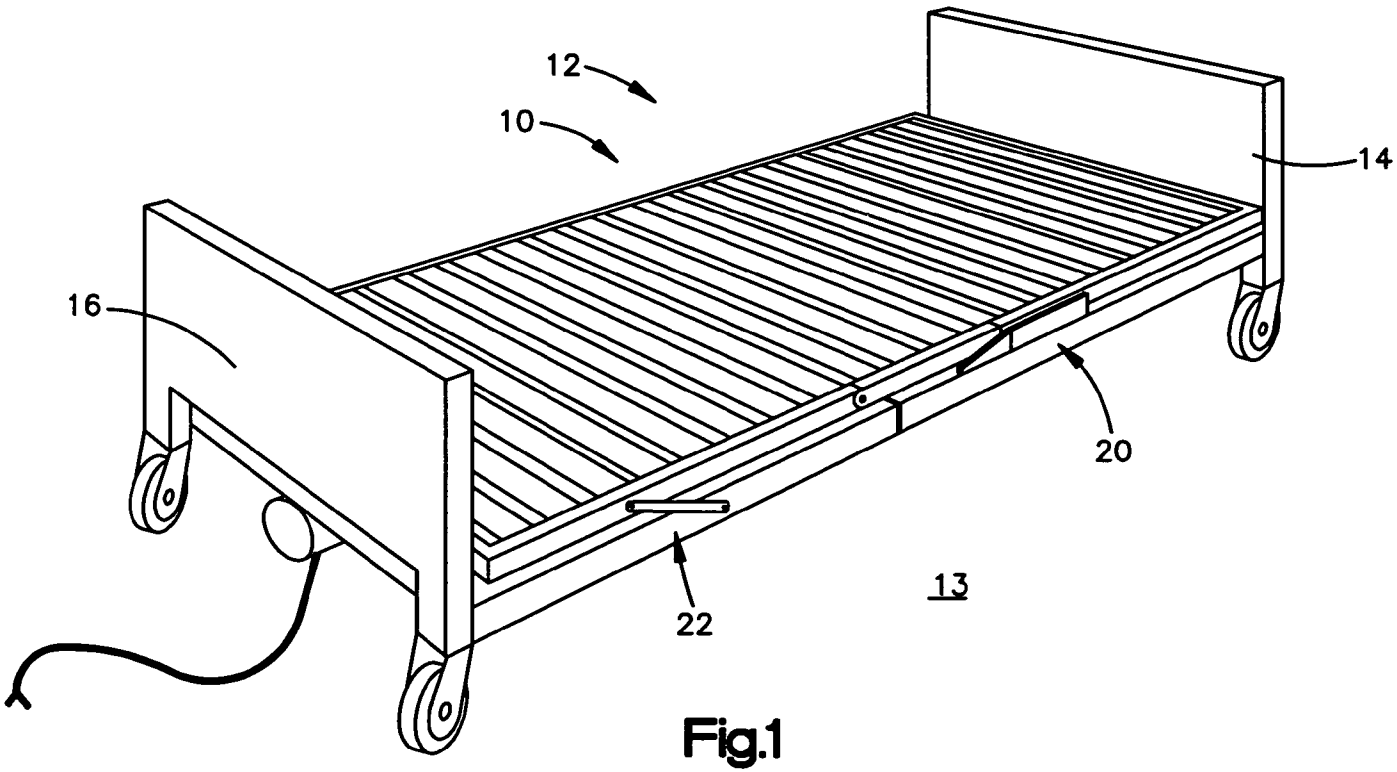
FIG. 1 is a perspective view of a bed including a mattress platform in accordance with the present invention, with the mattress removed for clarity.

The present invention relates to a bed, for example, for use in home health care. In particular, the present invention relates to a bed having a mattress platform that is made from two pieces. As representative of the present invention, FIG. 1 illustrates a mattress platform 10 that is one embodiment of the invention. The mattress platform 10 is illustrated as being part of a bed frame or bed 12 that is on a floor 13.

The bed 12 includes also a head end 14 and a foot end 16. The head end 14 of the bed 12 is preferably identical to, and interchangeable with, the foot end 16 of the bed. The bed ends 14 and 16 support the mattress platform 10 at a location off the floor 13. The bed ends 14 and 16 are preferably adjustable, so as to provide for vertical movement of the mattress platform 10 relative to the floor 12.

The mattress platform 10 includes a head end section 20 and a foot end section 22. The head end section 20 and the foot end section 22 are engageable with each other, as described below, to form the completed mattress platform 10.

The head end section 20 of the mattress platform 10 includes first and second side rails 30. The side rails 30 in the illustrated embodiment are formed as U-shaped channels open inwards, but could have another configuration. A plurality of slats 34 extend across and interconnect the side rails 30. The slats 34 have upper surfaces 36 that together form a supporting surface 38 for supporting a head end portion of a mattress (not shown).

The head end section 20 of the mattress platform 10 has an inner end portion 40 that includes first and second latching tongues 42 for engagement with the foot end section 22 of the mattress platform 10. The first tongue 42 is fixed, for example by welding, on the first side rail 30 of the head end section 20 of the mattress platform 10. The first tongue 42 may, alternatively, be formed as part of the side rail 30, for example, as a continuation of the outer wall 44 of the side rail. The tongue 42 has a generally planar configuration extending generally vertically when the head end section 20 is laid flat on the floor 13. The tongue 42 projects from the first side rail 30 and has beveled edges and a latching opening 44.

Figure 2:
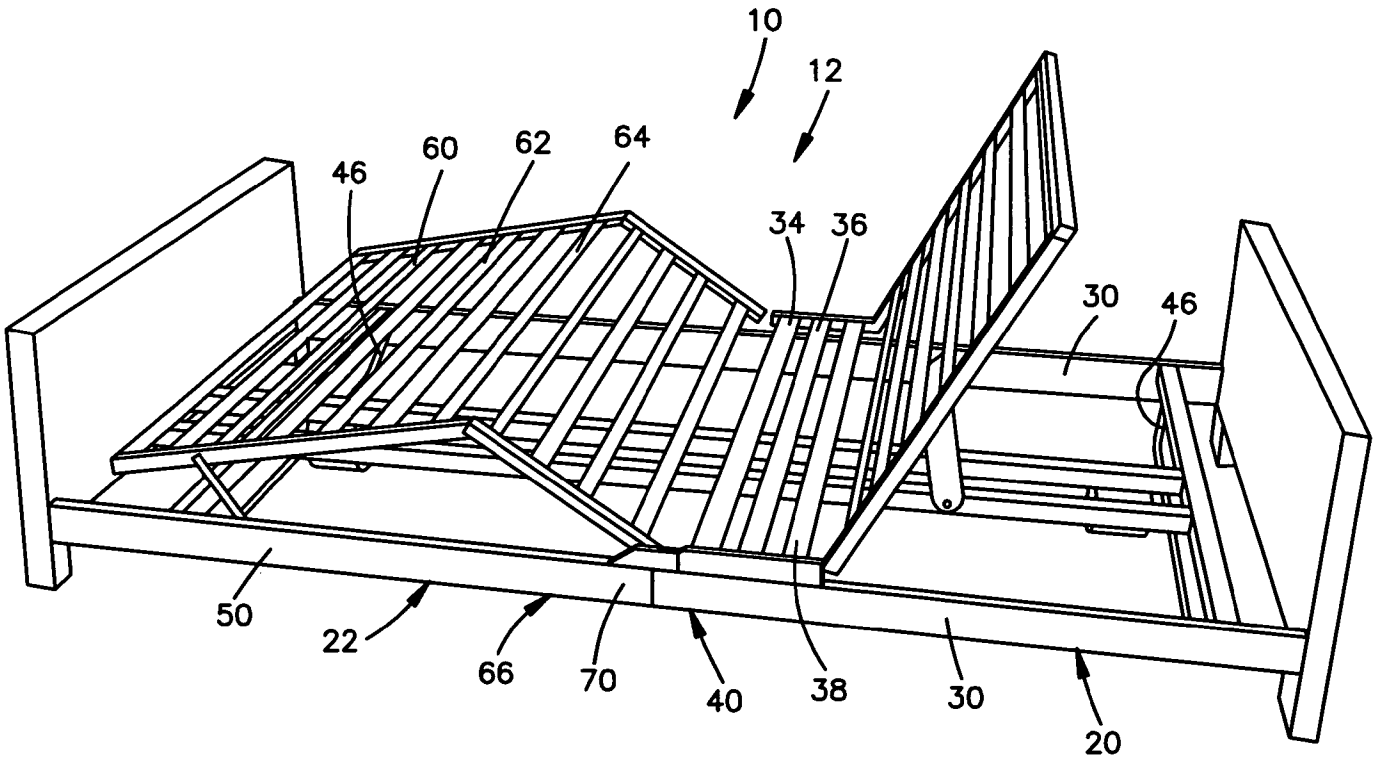
FIG. 2 is another perspective view of the bed of FIG. 1 showing portions of the mattress platform adjusted to different positions.
Figure 3:
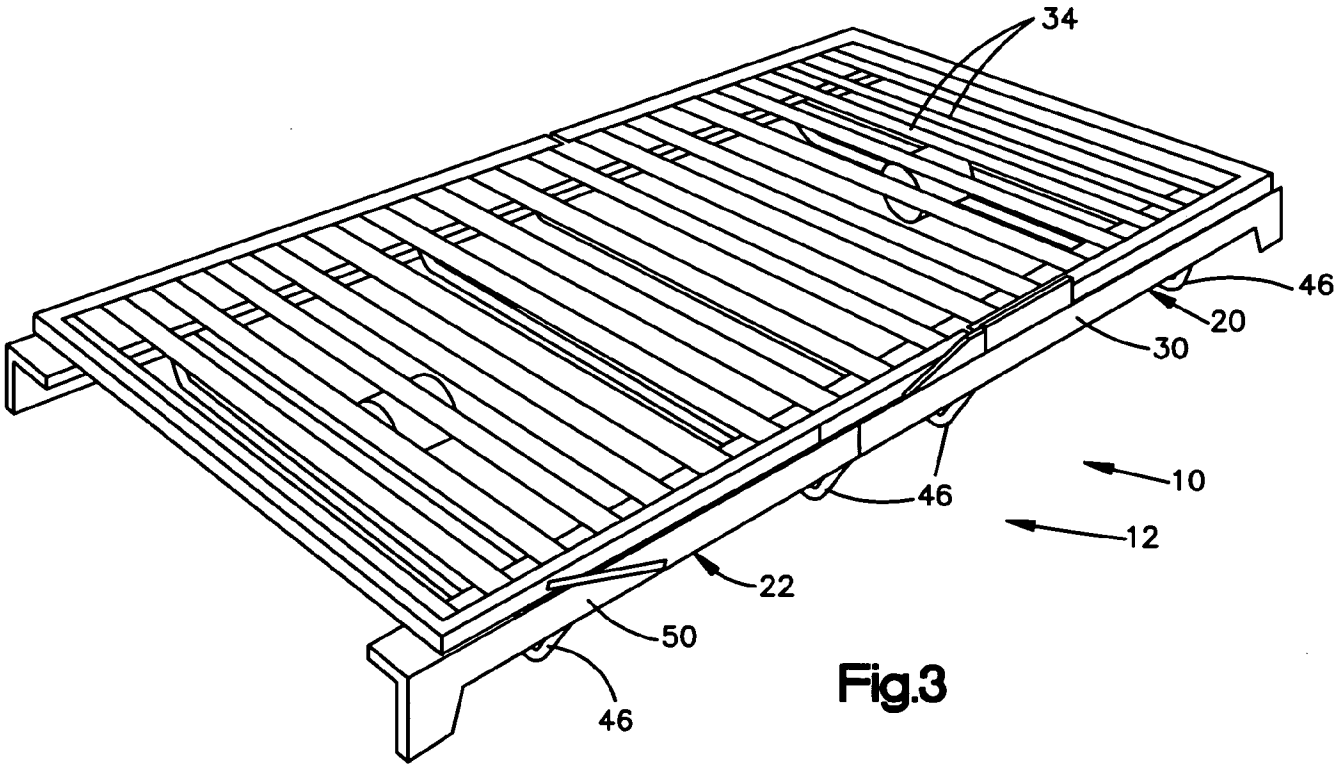
FIG. 3 is a view of the mattress platform of the bed of FIG. 1, shown in an assembled condition.
Figure 4:
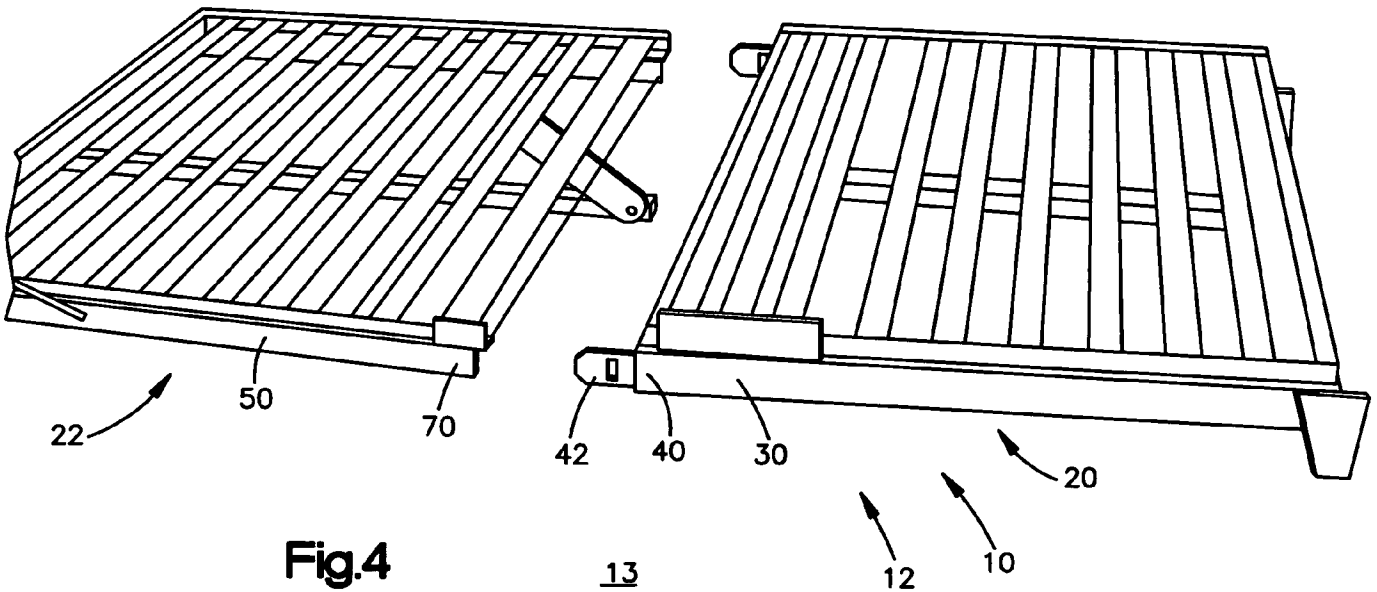
FIG. 4 is a view of the mattress platform alone, shown in a disassembled condition.
Figure 5:
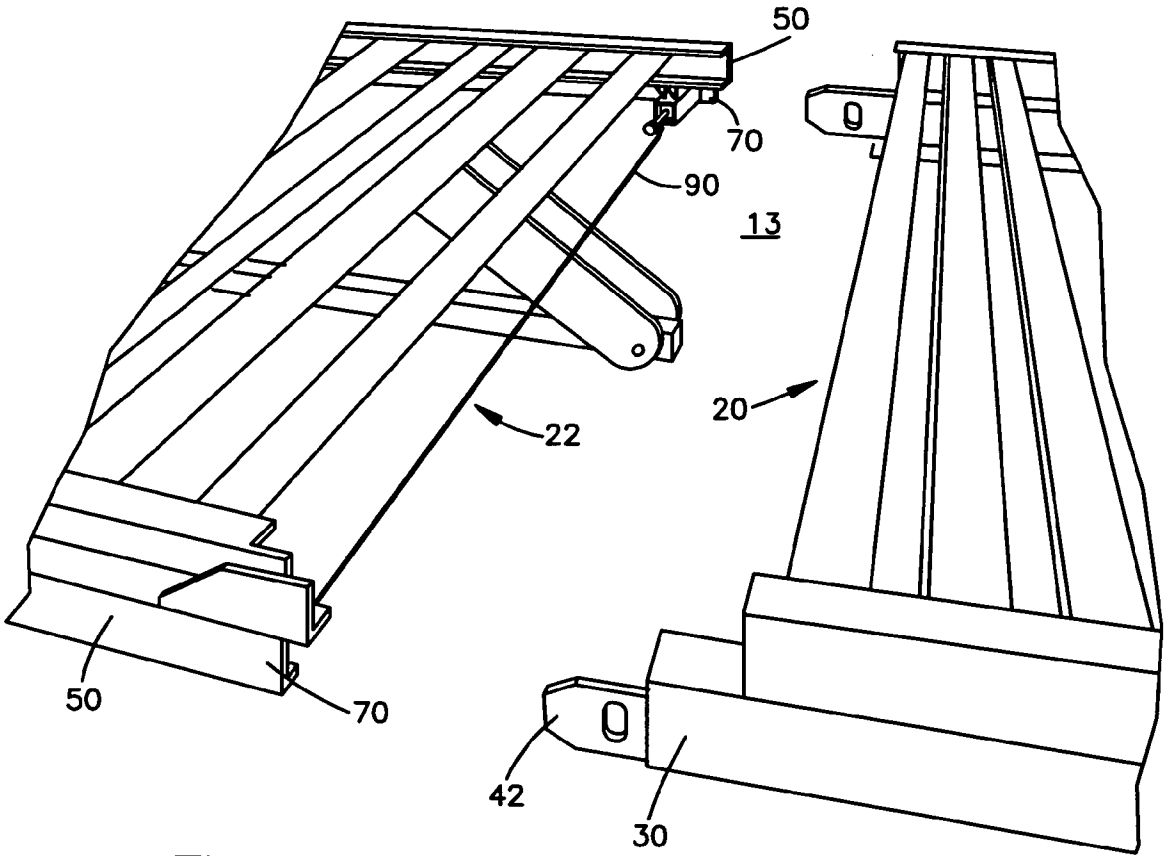
FIG. 5 is a view showing engagement portions of the two sections of the mattress platform.
Figure 6:
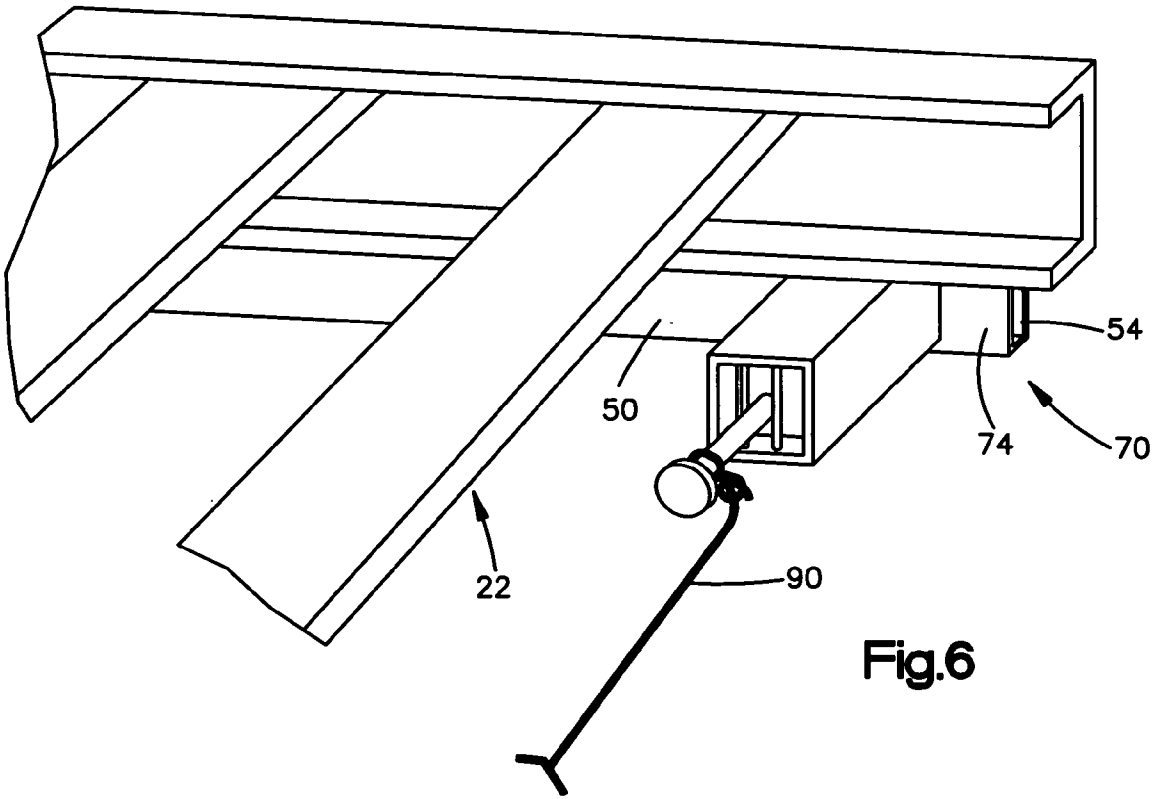
FIG. 6 is a close up view of a latching portion of one of the two sections of the mattress platform.
Figure 7:
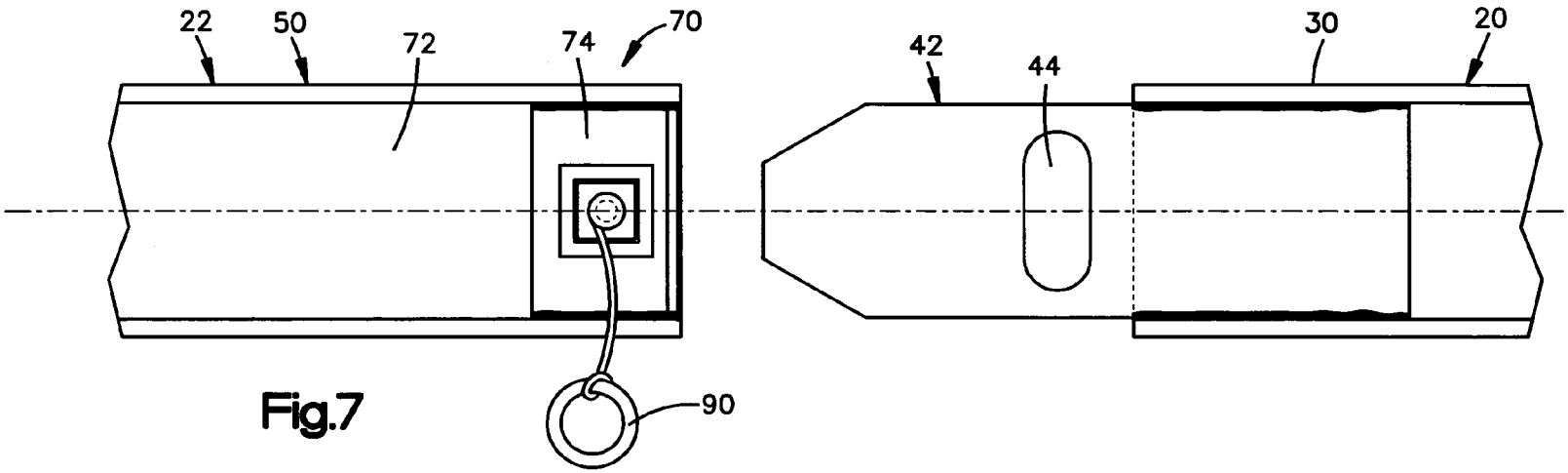
FIG. 7 is a bottom plan view showing a latching mechanism of the platform in an unlatched condition.
Figure 8:
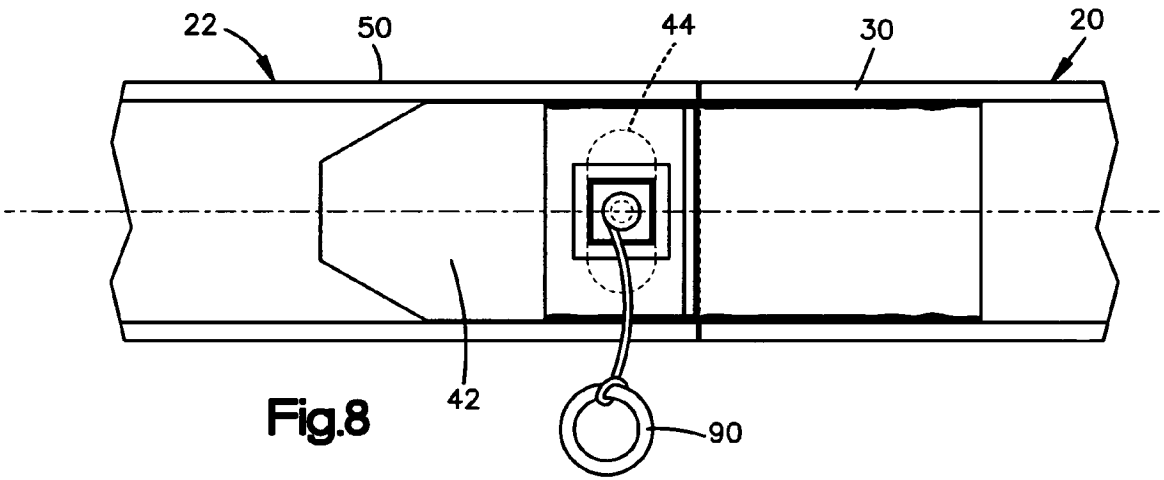
FIG. 8 is a view similar to FIG. 7 showing the latching mechanism in an assembled condition.
Figures 9, 10, 11:
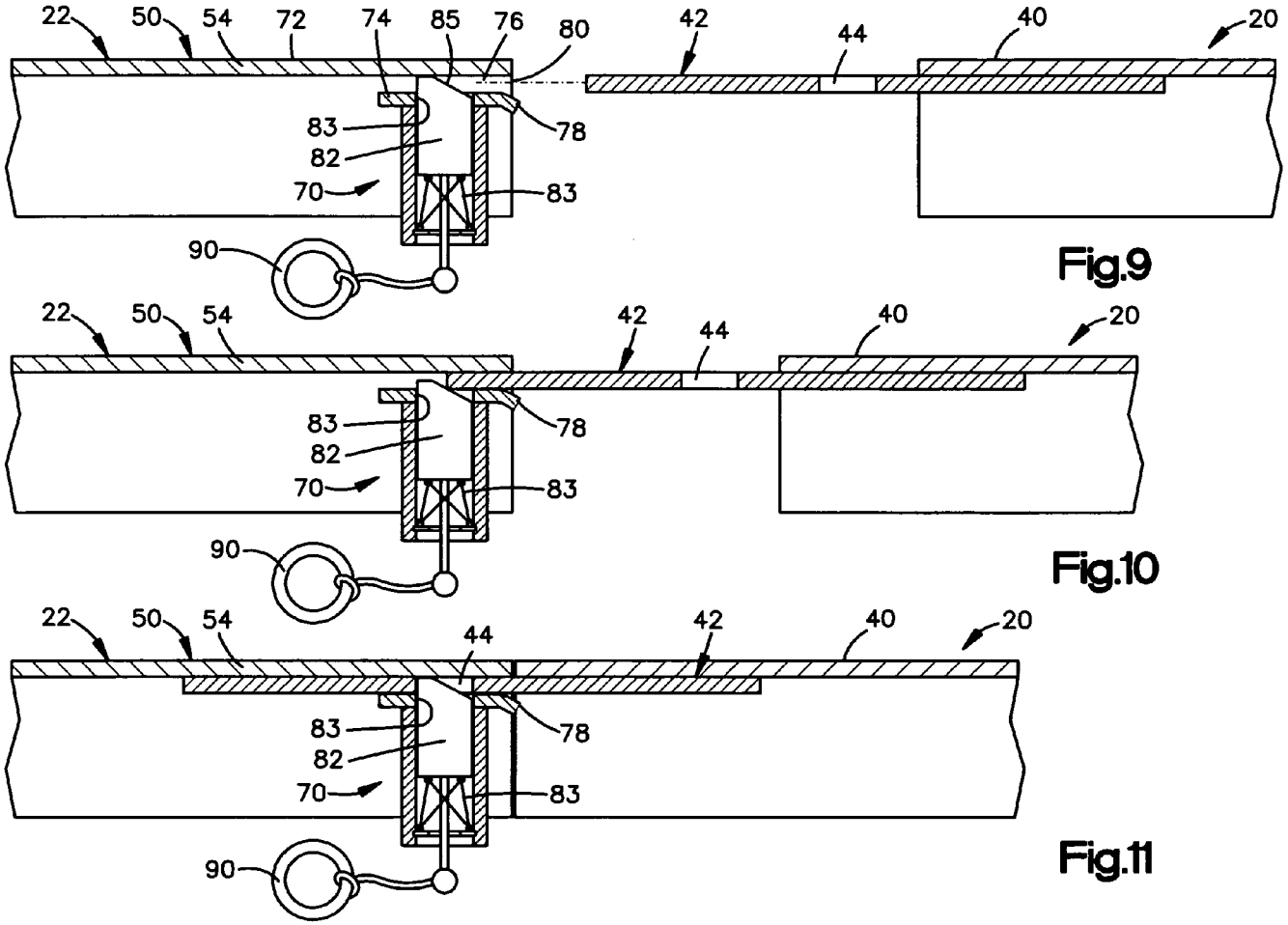
FIG. 9 is a sectional view showing the latching mechanism in an unlatched condition.
FIG. 10 is a view similar to FIG. 9 showing the latching mechanism in a partially latched condition.
FIG. 11 is a view similar to FIG. 10 showing the latching mechanism in a fully latched condition.
Figure 12:
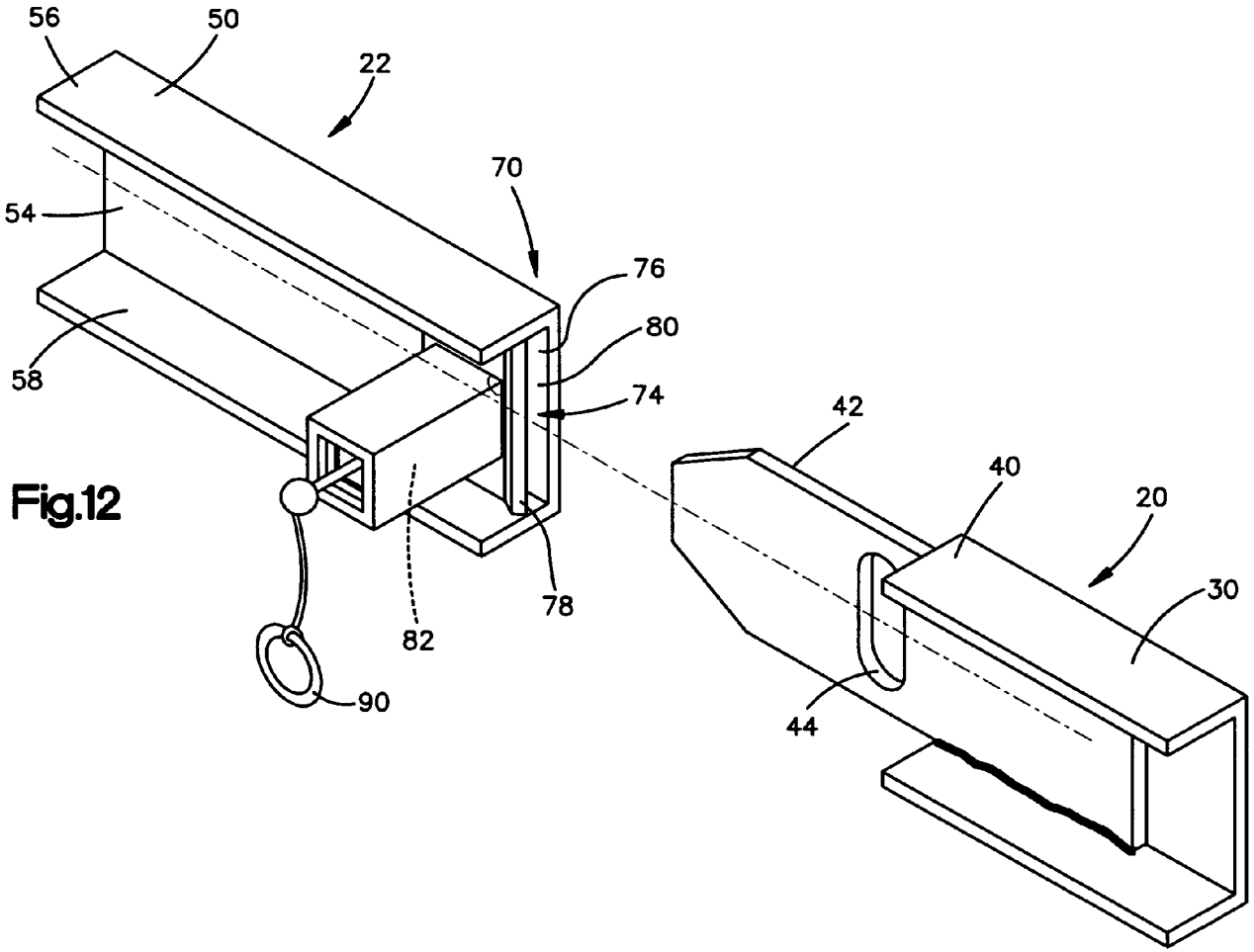
FIG. 12 is a perspective view showing the latching mechanism in an unlatched condition.

The head end section 20 also includes one or more motors, motor tubes, etc. for mechanical movement of its slats, for example, as shown in FIG. 2. The head end section 20 further includes two motor guards 46 for helping to protect these the working mechanisms of the head end section, when the head end section 20 is laid flat on the floor 13. The motor guards 46 in the illustrated embodiment are U-shaped tubes that support the side rails 30 and the working mechanisms off the floor 13.

The foot end section 22 of the mattress platform 10 includes first and second side rails 50. The side rails 50 in the illustrated embodiment are formed as U-shaped channels opening inward, but could have another configuration. The U-shaped configuration includes a side wall 54 and spaced top and bottom walls 56 and 58. A plurality of slats 60 extend across and interconnect the side rails 50. The slats 60 have upper surfaces 62 that together form a supporting surface 64 for supporting a foot end portion of a mattress (not shown). When the foot end section 22 of the mattress platform 10 is interlocked with the head end section 20 of the mattress platform 10 as described below, the supporting surface 64 on the foot end section 22 is aligned with the supporting surface 38 on the head end section 20 thereby to form a complete surface for supporting the mattress.

The foot end section 22 has an inner end portion 66 that includes first and second latching portions 70 for engagement with the tongues 42 of the head end section 20 of the mattress platform 10. The first latching portion 70 is located on the outer end of the first side rail 50 and may be formed in varying manners within the scope of the invention. In the illustrated embodiment, the latching portion 70 includes an outer end portion 72 of the side wall 54 of the side rail 50. The latching portion 70 also includes a plate 74 that is welded within the side rail 50, at a location parallel to and spaced apart from the side wall 54. The plate 74 and the side wall 54 define between them a latching chamber 76 in the latching portion 70 of the foot end section 22. The outer end 78 of the plate 74 is flared inward, away from the side wall 54, to form an enlarged opening 80 into the latching chamber 76.

The first latching portion 70 also includes a latch pin 82. The latch pin 82 is a movable member that is engageable in the latching opening 44 in the first tongue 42, to interlock the pieces. In the illustrated embodiment, the latch pin 82 is supported on the side rail 50 and the plate 74, for sliding movement in a direction normal to the side wall 54 and to the plate, that is, laterally inward and outward of the foot end section 22. The latch pin 82 is movable through an opening 83 in the plate 74 into engagement with the side wall 54. The latch pin 82 has a camming surface 85 that is presented toward the opening 80 of the chamber 76. The first latching portion 70 also includes a biasing member in the form of a spring 83 for biasing the latch pin 82 into an engaged position in which it extends through the opening 83 in the plate 74 and engages the side wall 54.

The foot end section 22 also includes one or more motors, motor tubes, etc. for mechanical movement of its slats, for example, as shown in FIG. 2. The foot end section 22 further includes two motor guards 46 for helping to protect these working mechanisms of the foot end section, when the head end section 20 is laid flat on the floor 13.

The platform 10 can be assembled, as described below, by one person, or can be easier to assemble by two persons than the prior art bed platform described above. To assemble the platform 10, the foot end section 22 of the mattress platform 10 is laid horizontal, or flat on the floor 13—that is, in an orientation generally parallel to the floor. The foot end section 22 rests on its motor guards 46, and need not be perfectly level, so long as it can hook up properly with the head end section 20.

The head end section 20 of the mattress platform 10 is also laid horizontal, or flat on the floor 13, adjacent to but spaced apart from the foot end section 22. The head end section 20 rests on its motor guards 46. In this condition, the two platform sections 20 and 22 are both horizontal and are generally parallel and co-planar. The latching tongues 42 on the head end section are close to but not engaged with the latching portions 70 on the foot end section 22. The two platform sections 20 and 22, together, take up only a little more room than they do when assembled.

The head end section 20 and the foot end section 22 are then moved horizontally into engagement with each other. One or the other or both of the platform sections 20 and 22 slide along the floor 13, on their respective motor guards 46, into engagement with each other. On each side of the platform 10, a tongue 42 moves into a latching chamber 76 of a latching portion 70, guided by the flared end portion 78 of the plate 74 and by the beveled edges of the tongue. As the tongue 42 moves farther into the chamber 76, the tongue engages the camming surface 85 on the latch pin 82. The tongue 42 cams the latch pin 82 inward, against the bias of the spring 83, so that the tongue can move completely into the chamber 76.

When the opening 44 in the tongue 42 moves into alignment with the latch pin 82, the biasing force of the spring 83 moves the latch pin down into and through the opening in the tongue. The latch pin 82 is thus then engaged in the opening 83 in the plate 74, as well as in the opening 44 in the tongue 42. As a result, the latch pin 82 blocks movement of the tongue 42 out of the latching 76 of the latching portion 70, so that the side rail 30 of the head end section 20 is locked to the side rail 50 of the foot end section 22.

On the opposite side of the bed 12, the second tongue 42 is also engaged with the second latching portion 70. It may be desirable or necessary to engage one side of the bed 12 before the other, possibly canting the head end portion 20 a little to enable this sequential engagement.

Thus, the inner end portion 40 of the head end section 20 and the inner end portion 66 of the foot end section 22 are moved into engagement with each other while they are disposed flat on the floor 13. This could entail moving the head end section 20 alone, or moving the foot end section 22 alone, or moving both sections.

After the platform 10 is thus assembled, the bed ends 14 and 16 are assembled to the platform 10. The bed ends 14 and 16 are, preferably, first adjusted to their lowest level. The outer end portion of the head end section 20 of the platform 10 is lifted off the floor 13 enough to enable it to be hooked onto the head end 14. The outer end portion of the foot end section 22 of the platform 10 is lifted off the floor 13 enough to enable it to be hooked onto the foot end 16. Any necessary connections of motors, motor tubes, etc. may then be completed.

To disassemble the platform 10, the latch pin 82 is removable from the opening in the tongue 42 by pulling on a cord or pin 90. Once both latch pins 82 are removed, the two platform sections 20 and 22 can be slid apart from each other, along the floor 13, to disengage them from each other.

The present invention is applicable to types of beds other than the type shown in the drawings and described above. Specifically, the invention is applicable to beds that do not have adjustable height bed ends; to non-motorized bed; and to non-bariatric bed, among others.

In addition, the platform 10 may be assembled, if desired, while on edge. That is, the head end section 20 and the foot end section 22 can be stood on edge and slid into engagement with each other, rather than being laid flat then slid into engagement with each other.

Figure 13:
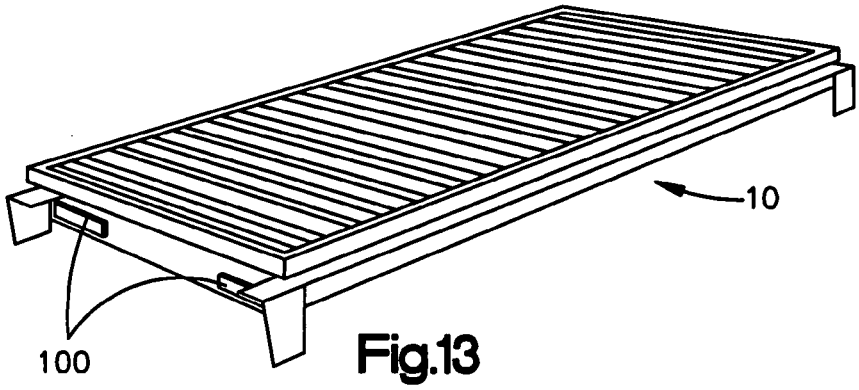
FIGS. 13-15 are views illustrating the use of temporary support legs on a mattress platform.
Figure 14:
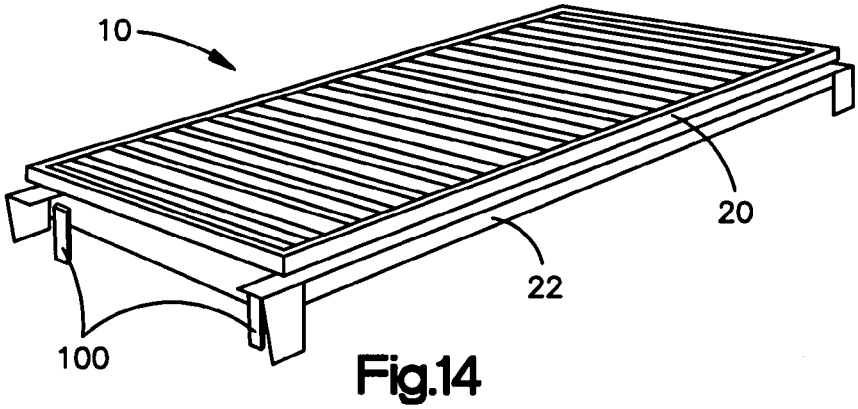
Figure 15:
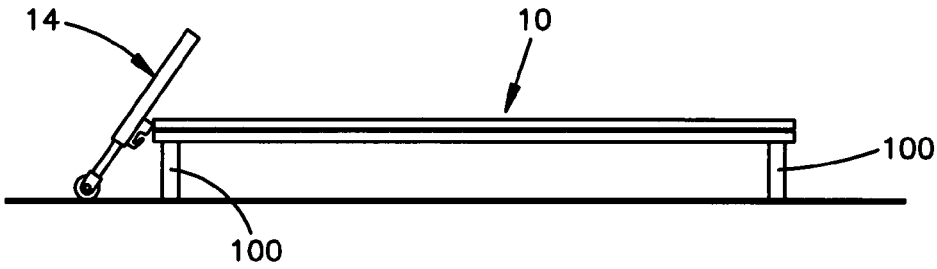

FIGS. 13-15 illustrate the use of temporary support legs 100 for holding the platform 10 off the floor 13 during assembly of the platform to the bed ends 14 and 16. Two support legs 100 are located on the head end section 20, and two on the foot end section 22. The support legs 100 are pivotable between a raised position, shown in FIG. 13, and a lowered position, shown in FIGS. 14 and 15. When the support legs 100 are in the lowered position, they support the platform sections 20 and 22 off the floor 13 by a sufficient distance so that they do not have to be lifted when assembling the bed ends 14 and 16.

This feature can help to make the bed assembly process easier for one person. Specifically, as illustrated in FIG. 15, when the legs 100 are folded down, the outer end portions of the platform 10 are high enough off the floor 13 so that the bed end 14 or 16 can be rotated into place and connected with the platform, without having to struggle with holding up the platform and simultaneously placing it on the hooks of the bed end. It should be noted that the support legs 100 are usable on beds other than that shown in the drawings, for example, on beds that do not have slidingly engageable first and second sections.

From the above description of the invention, those skilled in the art will perceive improvements, changes, and modifications in the invention. Such improvements, changes, and modifications within the skill of the art are intended to be included within the scope of the appended claims.

Having described the invention, I claim:

1. A bed platform for supporting a mattress, comprising:

a first section and a second section connectable to form at least a portion of said platform; and said platform including engageable parts on said first section and on said second section that are engageable in response to relative sliding movement between said first section and said second section when horizontal;

wherein said engageable parts are engageable in response to relative sliding movement of said first and second sections toward each other, and said engageable parts include first and second latching tongues on first and second side rails of said first section, and first and second latching portions on first and second side rails of said second section, each latching portion having a latching chamber for receiving a latching tongue and having a latch pin movable in the latching chamber;

each one of the latching tongues on the first section engaging in a respective latching chamber on the second section upon sliding movement of the first section into connection with the second section, each one of the latch pins of the second section moving into engagement in a latch opening in the associated latching tongue of the first section, to block movement of the first section away from the second section.

2. A bed platform as set forth in claim 1 wherein:

each latch pin is supported on the latching portion for movement in first and second directions, each latch pin having an associated spring that biases the latch pin in the first direction, each latch pin having a camming surface;

each latching tongue engaging the camming surface on an associated latch pin upon movement of the latching tongues into the latching chambers;

upon further movement of the latching tongues into the latching chambers, each latch pin being cammed into retracting movement in the second direction against the bias of its associated spring; and upon further movement of the latching tongues into the latching chambers, each latch pin moving in the first direction under the influence of its associated spring into the latch opening in the associated tongue, the engagement of the latch pins in the tongue openings locking the first and second sections together.

3. A bed platform as set forth in claim 2 wherein the latch pins are manually movable in the second direction out of the latch openings to release the latching tongues of the first section from the latching portions of the second section, thereby to enable sliding movement of the first and second sections away from each other.

4. A method of assembling a bed platform for supporting a mattress on a floor, the platform including a first section and a second section that are connectable with each other to form at least a portion of the platform, said method including the steps of:

placing the first section of the platform horizontal;

placing the second section of the platform horizontal and with an inner end portion of the second section adjacent to an inner end portion of the first section; and moving the inner end portion of the first section and the inner end portion of the second section in a first direction into engagement with each other while they are horizontal;

the inner end portion of the first section having first and second side rails each with a first latching mechanism;

the inner end portion of the second section having first and second side rails each with a second latching mechanism including a latch pin movable in a direction transverse to the first direction;

each one of first latching mechanisms of the first platform section being engageable with a respective second latching mechanism of the second platform section upon relative sliding movement in the first direction between the first section and the second section, each one of the latch pins of the second platform section moving transversely away from and then into engagement in a latch opening in an associated first latching mechanism, to block movement of the first section away from the second section.

5. A method as set forth in claim 4 wherein the step of moving the inner end portion of the first section and the inner end portion of the second section in a first direction into engagement with each other while they are horizontal, comprises:

engaging each latch pin of a second latching mechanism with a tongue of a first latching mechanism, and camming the latch pin transversely away from the tongue.

6. A bed platform for supporting a mattress, comprising:

a first platform section and a second platform section that are connectable by relative sliding movement in a first direction to form at least a portion of the platform:

the first platform section having first and second side rails, each having a first latching mechanism;

the second platform section having first and second side rails each having a second latching mechanism including a latch pin movable in a direction transverse to the first direction;

each one of first latching mechanisms of the first platform section being engageable with a respective second latching mechanism of the second platform section upon relative sliding movement in the first direction between the first section and the second section;

each one of the latch pins of the second platform section moving transversely away from and then into engagement in a latch opening in an associated first latching mechanism, to block movement of the first section away from the second section.

* * * * *